US007188747B2

(12) United States Patent
Bennett et al.

(10) Patent No.: US 7,188,747 B2
(45) Date of Patent: Mar. 13, 2007

(54) FLUID STORAGE TANK

(76) Inventors: Paul D. Bennett, Western Shelter Systems P.O. Box 2729, Eugene, OR (US) 97402; Paul J. Silva, Western Shelter Systems P.O. Box 2729, Eugene, OR (US) 97402; Theodore C. Kruysman, Western Shelter Systems P.O. Box 2729, Eugene, OR (US) 97402

( * ) Notice: Subject to any disclaimer, the term of this patent is extended or adjusted under 35 U.S.C. 154(b) by 533 days.

(21) Appl. No.: 10/731,997

(22) Filed: Dec. 9, 2003

(65) Prior Publication Data

US 2004/0118844 A1 Jun. 24, 2004

Related U.S. Application Data

(60) Provisional application No. 60/432,297, filed on Dec. 9, 2002.

(51) Int. Cl.
*B65D 90/20* (2006.01)

(52) U.S. Cl. ..... 220/565; 220/9.2

(58) Field of Classification Search ..... None
See application file for complete search history.

(56) References Cited

U.S. PATENT DOCUMENTS 4,356,933 A * 11/1982 Connolly ..... 220/9.4
5,592,702 A * 1/1997 Gillebaard, Jr. ..... 4/506
5,943,709 A * 8/1999 Chiu ..... 4/506

* cited by examiner

*Primary Examiner*—Stephen J. Castellano
(74) *Attorney, Agent, or Firm*—David S. Alavi

(57) ABSTRACT

A polygonal fluid storage tank comprises a tank frame and a tank liner. The tank frame comprises vertical support members, including upper and lower brackets, and upper and lower cross members secured to the brackets so as to enable relative angular motion between cross members and vertical support members. The tank frame may therefore be assembled on rough, uneven, and/or sloped terrain. The tank liner comprises a polygonal bottom panel and vertical side panels. Each side panel has a liner sleeve running along its upper edge open at both ends that is spaced apart from adjacent liner sleeves by liner gaps. Each upper cross member is positioned within a corresponding liner sleeve, and each of the upper brackets is positioned at a corresponding liner gap. The tank may be readily transported, assembled, filled, disassembled, and transported for fire fighting in remote areas.

45 Claims, 11 Drawing Sheets

FLUID STORAGE TANK

RELATED APPLICATIONS

This application claims benefit of prior-filed co-pending provisional App. No. 60/432,297 entitled "Fluid storage tank" filed Dec. 9, 2002 in the names of Paul D. Bennett, Paul J. Silva, and Theodore C. Kruysman (misspelled "Kraysman" in the provisional filing), said provisional application being hereby incorporated by reference as if fully set forth herein.

BACKGROUND

The field of the present invention relates to fluid storage tanks.

Portable fluid storage tanks may be useful in a variety of circumstances. Portable relay tanks are often used for fire-fighting, particularly in rural or wilderness areas. Relay tanks are typically available that include a rigid frame with a liner. Alternatively, a relay tank may be provided as a frameless, free-standing tank (essentially a bag-like liner with a stiff or rigid ring around its top opening. Rigid-framed tanks are most suitable for assembly or deployment on substantially flat, substantially horizontal surfaces. They may not be suitable for use on rough, uneven, and/or sloped terrain. Free-standing frameless tanks may be deployed on such terrain, but may be difficult to fill and may become mechanically unstable (i.e., they sometimes may tend to roll over, spilling the fluid contents).

SUMMARY

A fluid storage tank comprises a tank frame and a tank liner. The tank frame comprises a plurality of vertical support members, a plurality of lower cross members, and a plurality of upper cross members. Each vertical support member may comprise a substantially rigid substantially vertical frame member and upper and lower brackets secured thereto near its ends. Each lower cross member is substantially rigid and secured at its ends to the lower brackets of adjacent vertical support members. The lower cross members thus secured together form a lower closed polygon with one of the vertical support members positioned at each vertex. Each substantially rigid upper cross member is secured at its ends to the upper brackets of adjacent vertical support members. The upper cross members thus secured together form an upper closed polygon with one of the vertical support members at each vertex. The lower polygon substantially corresponds in size and shape to the upper polygon. The tank liner comprises a polygonal bottom panel, substantially corresponding in size and shape to the upper and lower polygons, and a plurality of substantially vertical side panels. Each side panel is secured at its lower edge to a side edge of the polygonal bottom panel and at its side edges to side edges of adjacent side panels. Each side panel has a liner sleeve running along its upper edge open at both ends and corresponding to a side of the upper polygon. The liner sleeves are spaced apart by liner gaps between them, with each liner gap corresponding to a vertex of the upper polygon. Each upper cross member is positioned within a corresponding liner sleeve, and each of the upper brackets is positioned at a corresponding liner gap. Each of the upper and lower cross members is secured to respective upper and lower brackets of the vertical support members so as to enable relative angular motion between vertical frame members and upper and lower cross members.

Objects and advantages pertaining to fluid storage tanks may become apparent upon referring to the disclosed embodiments as illustrated in the drawings and disclosed in the following written description and/or claims.

The embodiments shown in the Figures are exemplary, and should not be construed as limiting the scope of the present disclosure and/or appended claims.

DETAILED DESCRIPTION OF EMBODIMENTS

Figure 1:
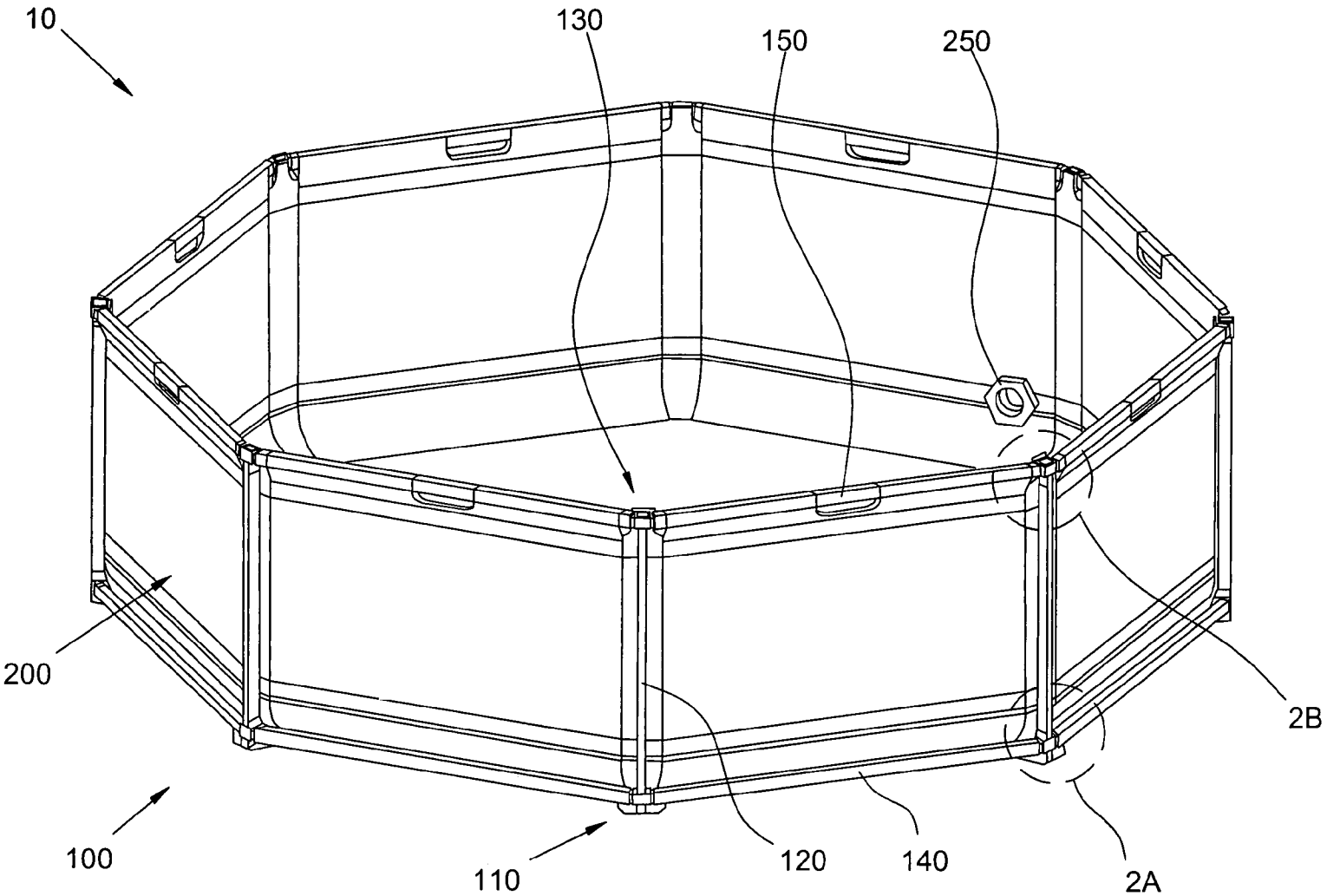
FIG. 1 is a perspective view of an assembled fluid storage tank.
Figure 3A:
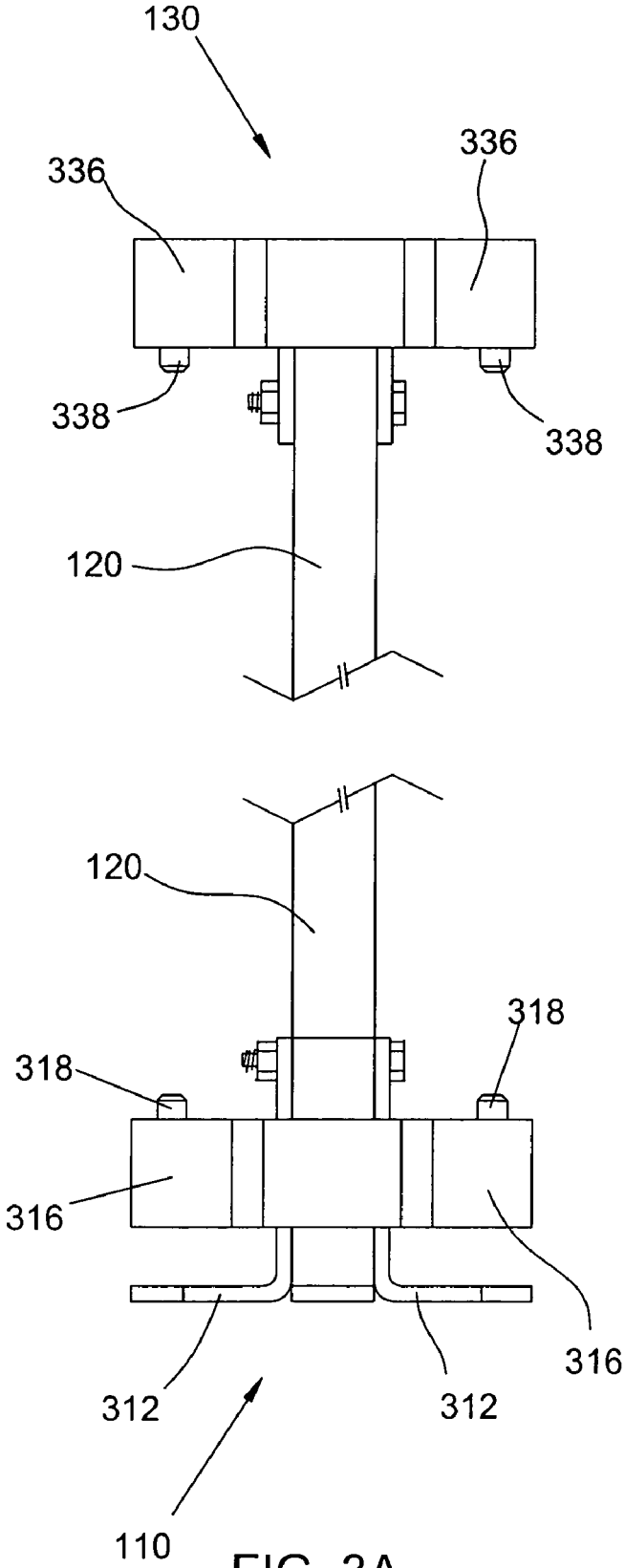
FIGS. 3A, 3B, and 3C illustrate vertical support members including upper and lower brackets
Figure 3B:
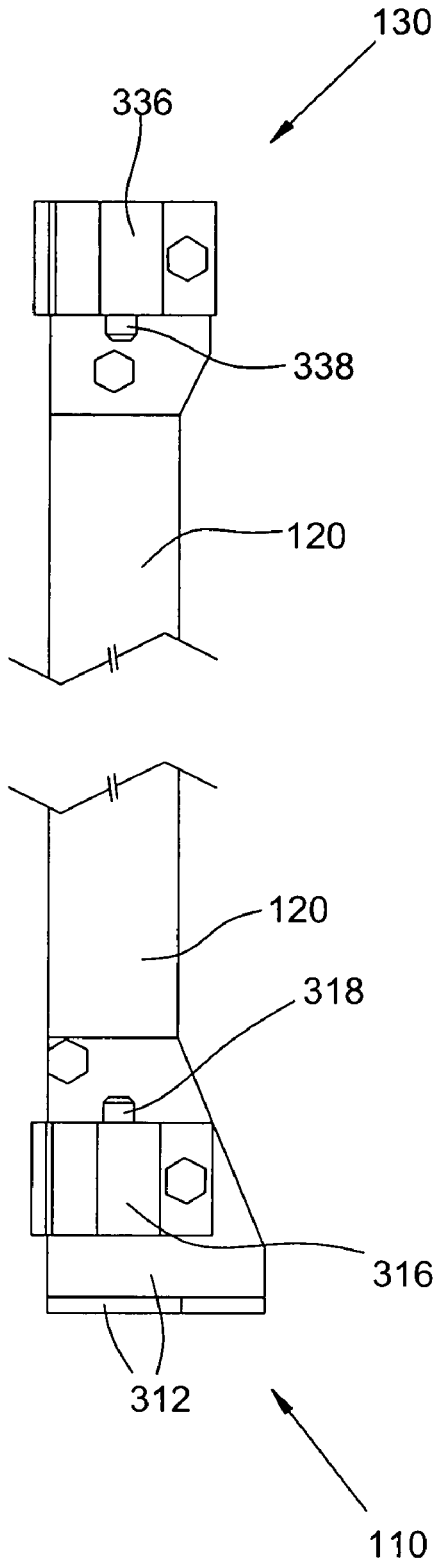
Figure 3C:
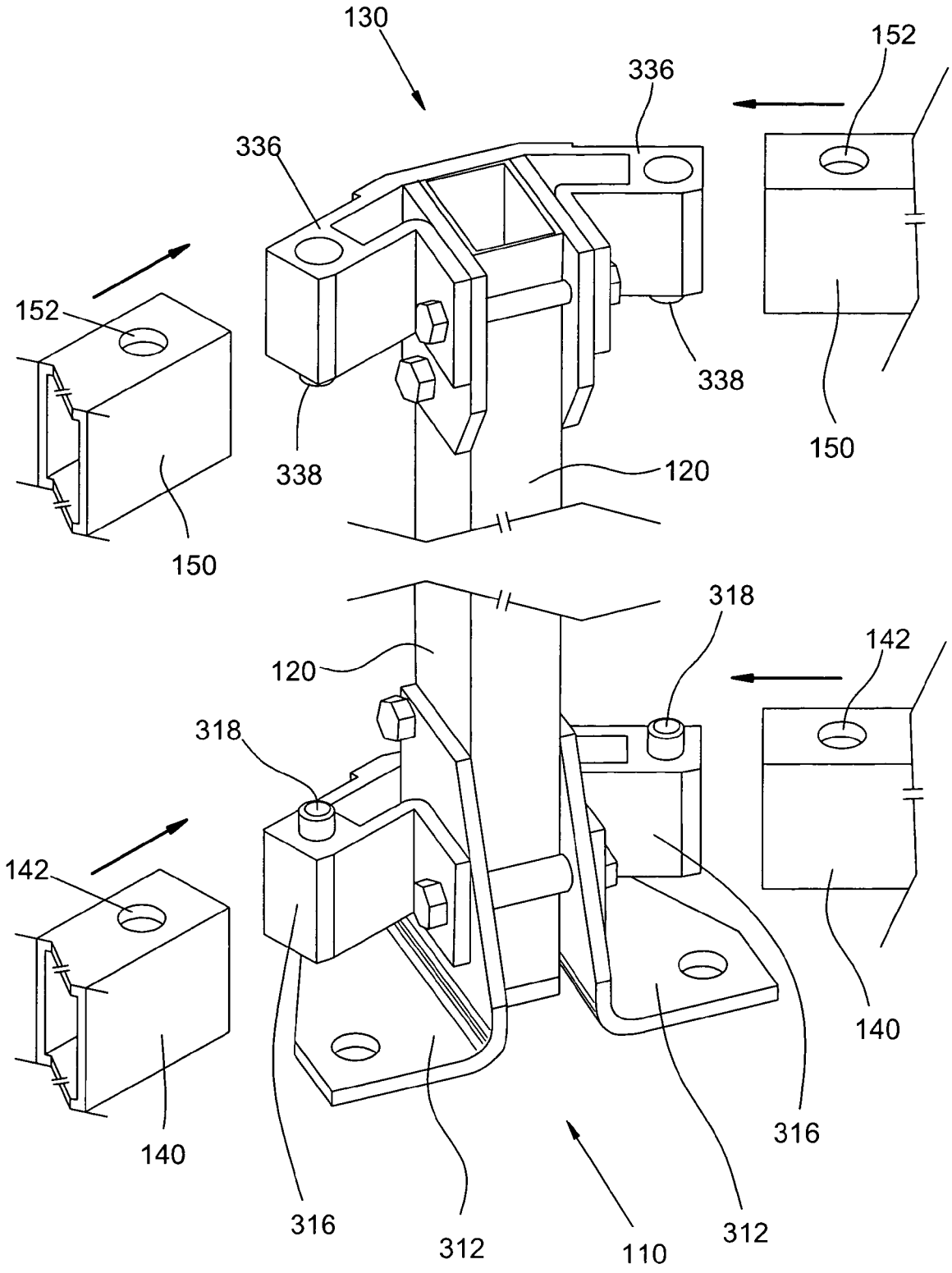
Figure 4:
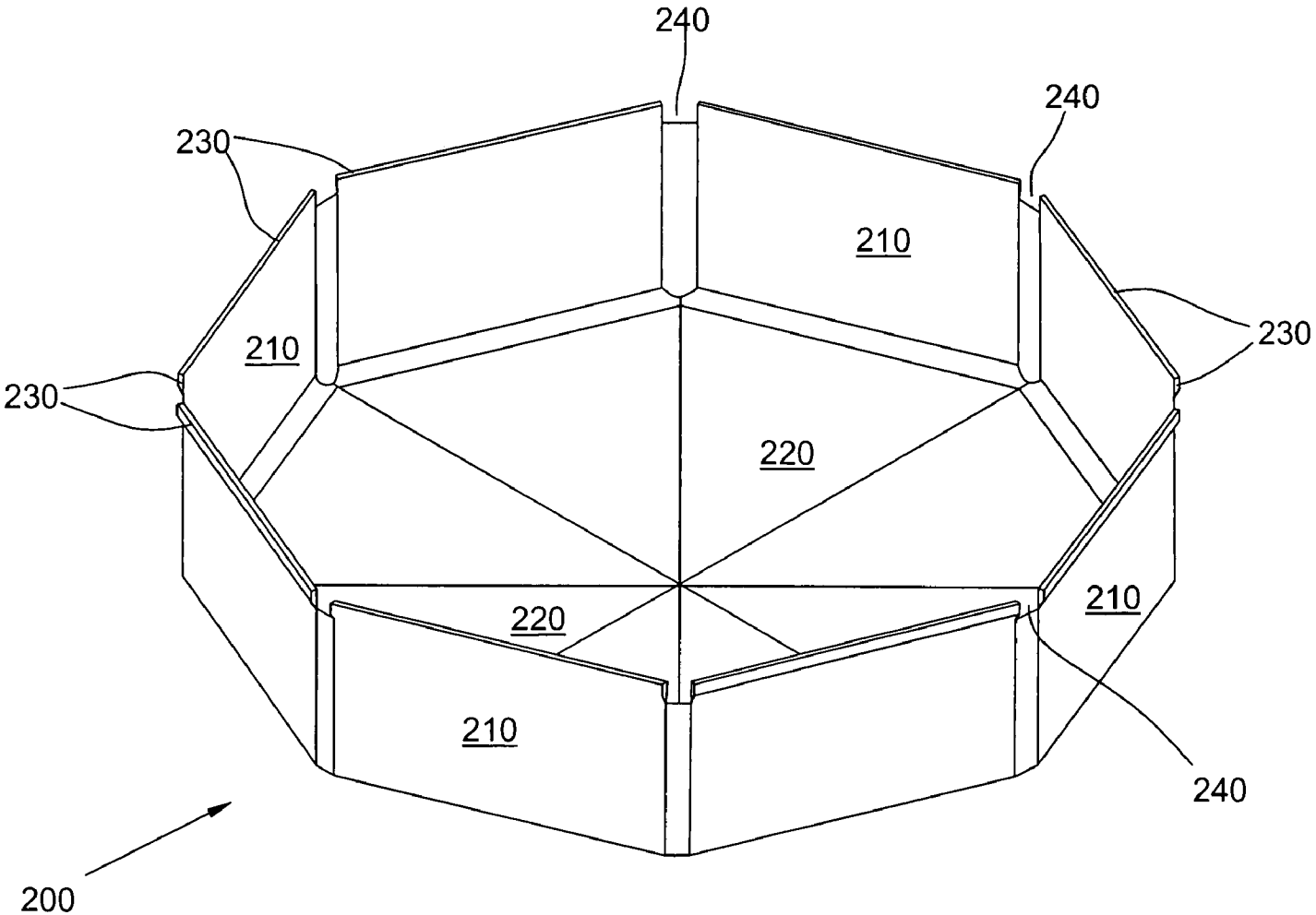
FIG. 4 is a perspective view of a tank liner.
Figure 5A:
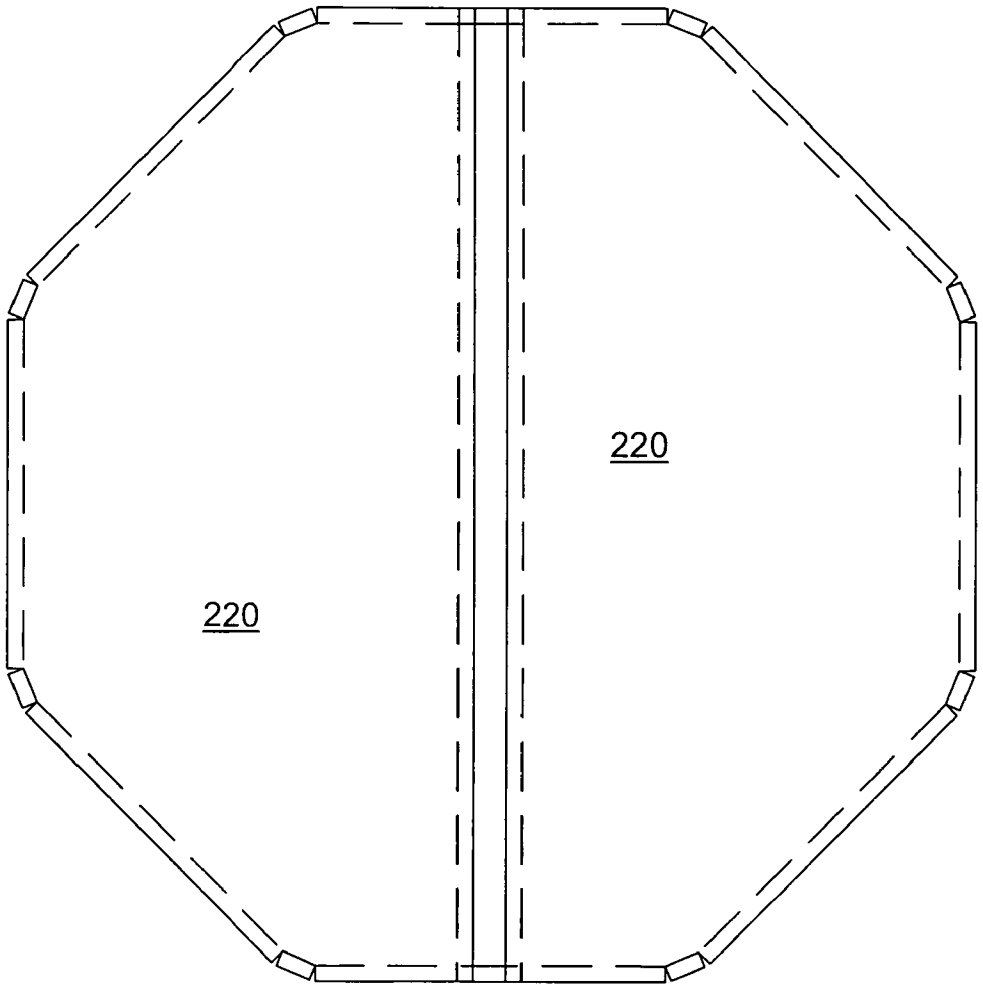
FIGS. 5A and 5B show segments for constructing a tank liner.
Figure 6A:
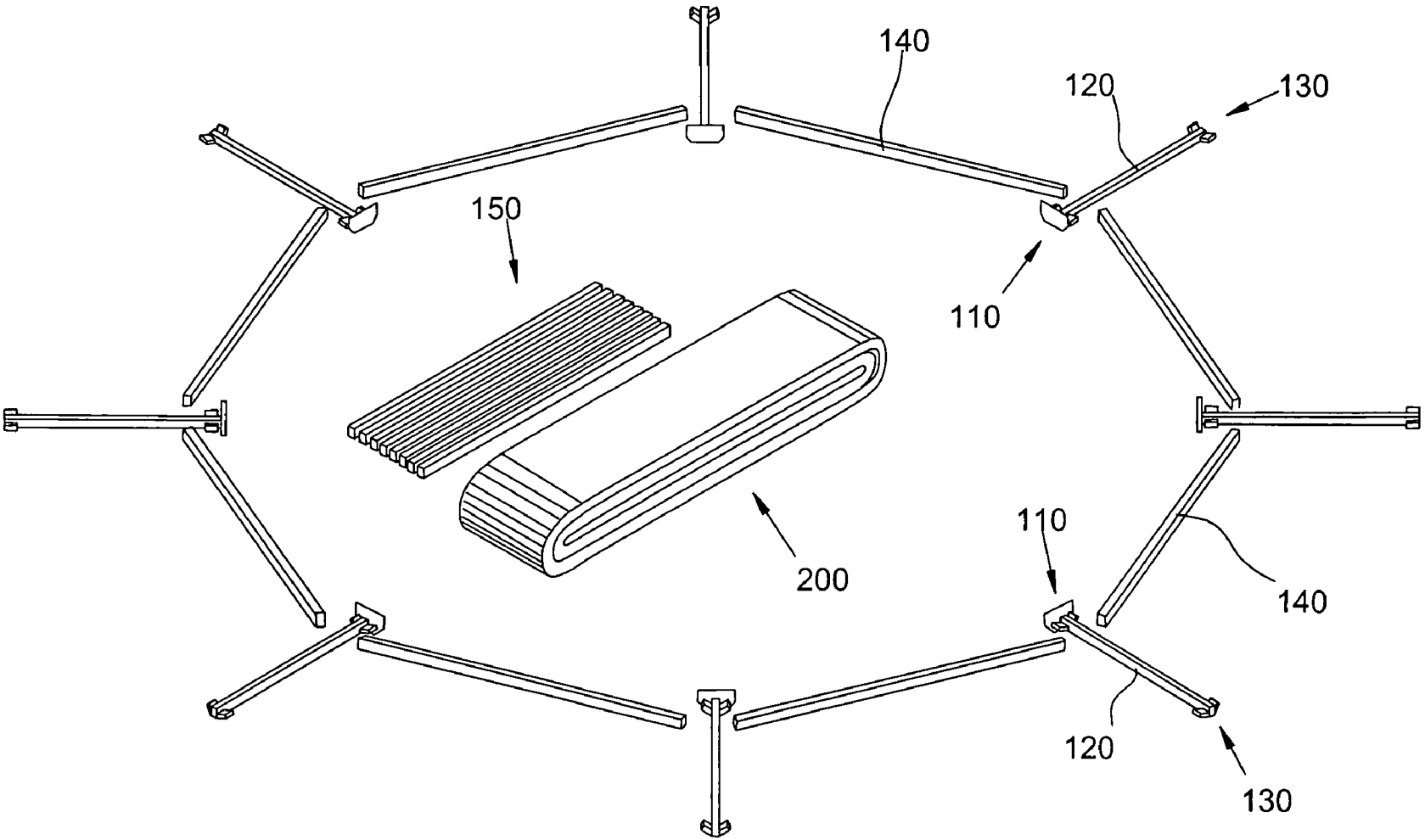
FIGS. 6A, 6B, 6C, and 6D illustrate a procedure for assembling a fluid storage tank.

An exemplary embodiment of a fluid storage tank 10 is shown assembled in FIG. 1, and includes a tank frame 100 and a tank liner 200. Details of the structure of the assembled tank 10 are shown enlarged in FIGS. 2A/2B. FIGS. 3A/3B/3C show details of vertical support members of the tank frame 100, the vertical support members each including a lower bracket 110, tank frame vertical member 120, and upper bracket 130. FIGS. 4 and 5A/5B show the tank liner 200 and segments from which it may be constructed. FIGS. 6A/6B/6C/6D illustrate a procedure for assembling the fluid storage tank 10.

Tank frame 100 comprises a plurality of vertical support members positioned at the vertices of a polygon. Eight vertical support members are shown in the exemplary embodiment, forming an octagonal tank. Tanks having any desired number of sides from three on up may fall within the scope of the present disclosure and/or appended claims. Fewer sides require fewer parts and may offer greater ease of assembly, while more numerous sides may allow use of smaller parts and assembly of the tank in a wider variety of deployment circumstances. Tanks having five to ten sides are suitable for most deployment conditions, and tanks having six or eight sides are suitable for many typical deployment situations. The vertical support members each include a substantially rigid substantially vertical member 120 with a lower bracket 110 secured thereto near the lower end thereof and an upper bracket 130 secured thereto near an upper end thereof. The lower bracket 110 may also serve as a footing or base member for the vertical support. The lower brackets 110 are secured to the ends of a corresponding number of lower cross members 140 to form a lower portion of the polygonal tank frame (eight lower horizontal bars in the exemplary embodiment, yielding an octagonal lower frame portion). The upper brackets 130 are similarly secured to the ends of a corresponding number of upper cross members 150, forming an upper tank frame portion substantially corresponding in polygonal shape to the lower tank frame portion. The cross members (upper and lower; 140/150) are secured to the corresponding upper and lower brackets 110/130 so as substantially resist tensile forces acting to pull the cross members 140/150 away from the brackets 110/130, while nevertheless allowing a degree of relative angular movement between the cross members 140/150 and the vertical members 120. Details of the connection between the brackets 110/130 and the cross members 140/150 for enabling such movement in the exemplary embodiment are shown in FIGS. 2A/2B and 3A/3B/3C, and are disclosed in more detail hereinbelow.

Figure 5B:
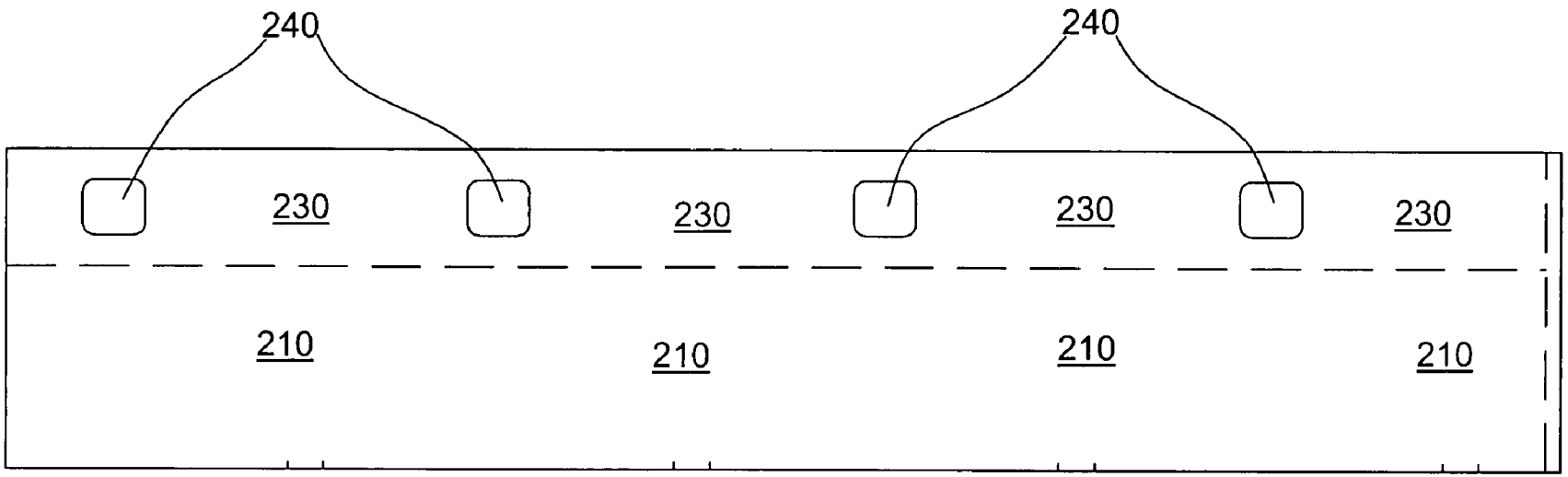

The tank liner 200 and its construction are illustrated in FIGS. 4 and 5A/5B. A polygonal liner base panel or sheet 220 and liner wall panels or sheets 210 are made from a flexible and substantially fluid-impervious material. The polygonal liner base roughly corresponds in size and shape to the tank frame, and may comprise a single contiguous sheet or multiple assembled segments (several segments are shown joined along the seam lines in FIGS. 4 and 5A, for example). The liner side panels 210 may comprise a single elongated contiguous sheet of liner material with its ends joined together to form a ring, or may comprise multiple assembled segments forming a ring. The segment shown in FIG. 5B accounts for four liner side panels 210, and two such segments would be required to form the eight side panels required for the octagonal tank of the exemplary embodiment. Liner side panels 210 are joined along their lower edges to the outer edge of the liner base panel 220, and along their side edges to adjacent side panels if needed. Alternatively, the base panel 220 and side panels 210 may all be formed from a single contiguous sheet of material, with suitably located seams. The top edge of each liner side panel 210 is provided with a liner sleeve 230 for receiving one of the upper horizontal frame bars 150 therethrough. Liner gaps 240 are provided along the top edge of the liner side panels 210 between liner sleeves 230 at intervals corresponding to the vertices of the polygonal tank shape. The segment of FIG. 5B is folded over along the top edge an secured along the dashed seam line to form liner sleeves 230. The holes near the top edge of the sheet of FIG. 5B become liner gaps 240 when the top edge is folded over. When the tank is assembled, each upper bracket 130 is positioned at a liner gap 240. Each upper cross member 150 is positioned within a liner sleeve 230 with its ends protruding into adjacent liner gaps 240 and secured to adjacent upper brackets 130. The top edge of the tank liner is thereby directly supported by the upper cross members 150. When filled with fluid, the tank liner 200 is supported from below by the surface on which the tank is assembled. The tank liner sides 210 are laterally supported in part by vertical members 110, which come into contact with the outer surface of liner side panels 210 as they are forced outward by fluid in the tank.

The angular motion between cross members 140/150 and vertical members 120 enables placement of the tank frame 100 on support surfaces that are not flat and/or are not horizontal. For example, use of tank 100 as a relay water tank for wilderness fire-fighting may necessitate its use on rough, uneven, and/or sloped terrain. A rigid tank frame may be unsuitable for such a use environment. Tank frame 100, with flexible joints where cross members 140/150 are secured to brackets 110/130 of the vertical support members, allows the tank frame to conform to rough, uneven, and/or sloped terrain while supporting the tank liner. Once the tank frame 100 is deployed with the liner 200 in place, filling the tank contributes to the overall structural integrity of the tank. The outward pressure exerted by fluid held within the tank results in tensile forces pulling the cross members 140/150 away from the respective brackets 110/130. Whereas the tank frame is flexible upon initial deployment and able to conform to the support surface, the outward pressure and tensile forces cause the frame to become substantially rigid upon filling of the tank (while remaining in the shape assumed upon initial assembly).

Figure 2B:
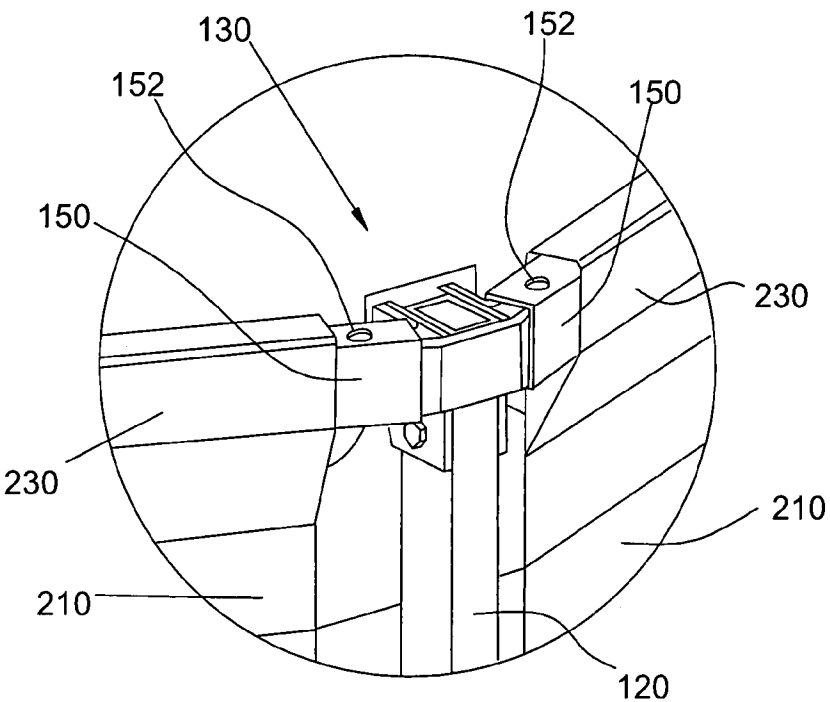
FIGS. 2A and 2B are enlarged views of portions of FIG. 1.
Figure 2A:
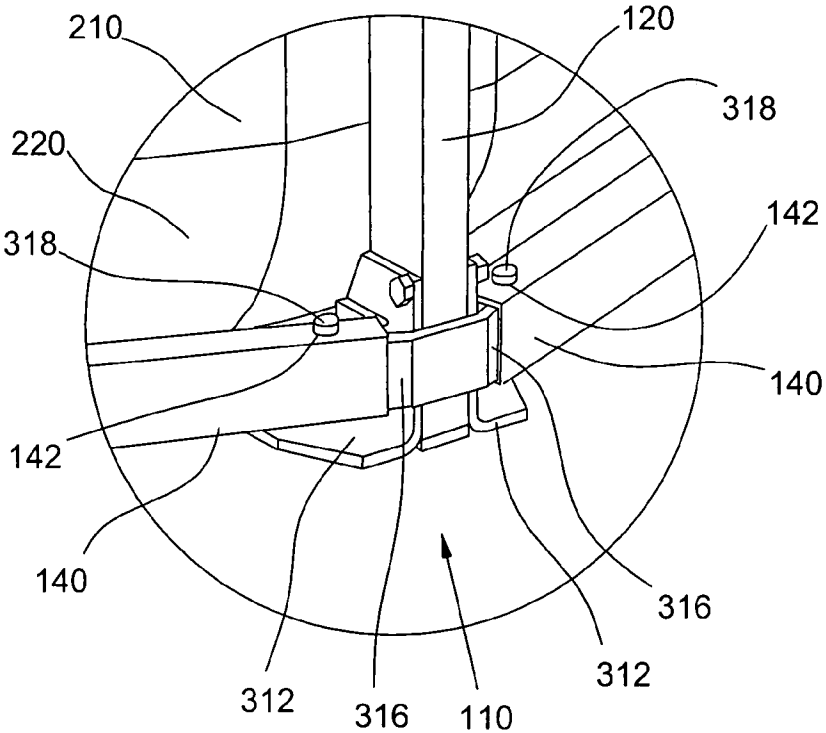

Exemplary brackets 110/130 are shown in FIGS. 2A/2B and 3A/3B/3C for securing cross members 140/150 to vertical members 120. In the exemplary embodiment, cross members and vertical members are extruded rectangular metal tubes. The cross members and vertical members may have a substantially similar cross-sectional size/shape, or the cross members may differ from the vertical members in cross-sectional size/shape. Similarly, upper and lower cross members may have substantially similar or differing cross-sectional size/shape. Use of a single cross-sectional size/shape simplifies manufacturing of tank frame components, while differing cross-sectional size/shape enables each type of member to be tailored to its particular structural requirements. Frame members 120/140/150 may be provided in any other mechanically suitable configuration while remaining with the scope of the present disclosure and/or appended claims. Examples of such configurations may include, but are not limited to: square and/or rectangular cross-sections; polygonal cross-sections (regular and/or irregular); circular, elliptical, and/or oval cross-sections; tubular members; solid members; angled and/or channeled members; I-beam-like members; and so forth. Frame members 120/140/150 and other components of tank frame 100 may be fabricated using any suitable material(s) providing sufficient strength and rigidity for supporting the tank liner and fluid stored therein. Such materials may include, but are not limited to: metals, alloys, wood, plastics, polymers, composites, combinations thereof, and/or functional equivalents thereof.

Lower bracket 110 includes a pair of angled footings 312 secured to opposing faces of vertical member 120 and forming a base for the vertical support. Lower bracket 110 further includes a pair of transverse bracket tabs 316 extending from opposing faces of the vertical member at an angle substantially corresponding to an angle of the polygonal tank shape. The transverse bracket tabs have a cross-sectional shape substantially similar to the cross-sectional shape of the inner surface of the lower cross members 140. Upon assembly of the tank frame 100, transverse bracket tabs 316 are inserted into the ends of the lower cross members 140. Each end of each lower cross member 140 is provided with a hole 142, while each transverse bracket tab 316 is provided with a retaining pin 318. During assembly, the retaining pin 318 is retracted for insertion of the transverse bracket tab 316 into the end of the lower cross member 140, and then extended and inserted through hole 142 for retaining lower cross member 140 secured to bracket 110. The retaining pin 318 may be spring-loaded for urging it into an extended position. For disassembling tank frame 100, retaining pin 318 is retracted and lower cross member 140 is removed from transverse bracket tab 316.

Upper bracket 130 includes a pair of transverse bracket tabs 336 extending from opposing faces of the vertical member at an angle substantially corresponding to an angle of the polygonal tank shape. The transverse bracket tabs have a cross-sectional shape substantially similar to the cross-sectional shape of the inner surface of the upper cross members 150. Upon assembly of the tank frame 100, transverse bracket tabs 336 are inserted into the ends of the upper cross members 150. Each end of each upper cross member 150 is provided with a hole 152, while each transverse bracket tab 336 is provided with a retaining pin 338. During assembly, the retaining pin 338 is retracted for insertion of the transverse bracket tab 336 into the end of the lower cross member 140, and then extended and inserted through hole 152 for retaining lower cross member 150 secured to bracket 130. The retaining pin 338 may be spring-loaded for urging it into an extended position. For disassembling tank frame 100, retaining pin 338 is retracted and upper cross member 150 is removed from transverse bracket tab 336.

The tank frame 100 may be implemented in any suitable polygonal shape. Regular polygons offer the greatest simplicity of assembly, since all cross members are substantially the same length and all brackets are configured at substantially the same angle (parts therefore being interchangeable). Upon filling the tank, the fluid pressure maybe most evenly distributed around the perimeter of a regular polygon, which may therefore provide the most stable tank. However, other polygonal shapes may be employed and fall within the scope of the present disclosure and/or appended claims. These may include regular polygons, polygon having all angles substantially equal with sides of differing lengths, polygons with all sides substantially equal with differing angles, and/or polygons wherein both side length and angle vary. Also included are tank frames in which longer sides may in fact comprise multiple side panels connected at about 180° (with a vertical support member between adjacent side panels).

For facilitating manufacture and assembly of tank frame 100, each opposing pair of transverse bracket tabs 316 or 336 may comprise a unitary structure as shown in the exemplary embodiment. The transverse bracket tab unitary structure of the exemplary embodiment is adapted for receiving (between the transverse bracket tabs) the vertical member 120. For the lower bracket 110, the angled footings 312 are also inserted between the transverse bracket tabs 316, and the transverse bracket tabs 316, angled footings 312, and vertical member 120 are secured together with fasteners 112. For upper bracket 130, the vertical member 120 is inserted between transverse bracket tabs 336, and the transverse bracket tabs 336 and vertical member 120 are secured together with fasteners 132. For further facilitating manufacture and assembly of the tank frame 100, upper and lower cross members 140/150 may be substantially identical, as well as lower/upper transverse bracket tabs 316/336 (including corresponding retaining pins 318/338). For further facilitating manufacture and assembly of the tank frame 100, unitary structures for transverse bracket tabs 316 and 336 may be substantially identical. Spacers 332 may be provided for the upper bracket 130 to fill the space between the transverse bracket tabs occupied by angled footings 312 of the lower bracket 110. Use of substantially identical components for the tank frame reduces the number of differing parts that must be fabricated, and reduces the number of differing parts to be selected from during assembly of the tank frame. Tank frame 100 may nevertheless be constructed using non-identical components while remaining within the scope of the present disclosure and/or appended claims.

Varying degrees of angular motion may be allowed by the attachment of cross members 140/150 to vertical members 120 via brackets 110/130. Relative angular motion between cross members 140/150 and vertical members 120 may be provided in any suitable way by appropriate mechanical configuration of frame members 120/140/150 and/or brackets 110/130. In the exemplary embodiment, angular motion between the frame members is enabled by providing cross members 140/150 with inner surface cross-sections somewhat over-sized relative to cross-sections of transverse brackets tabs 316/336. The size mismatch allows some play between the over-sized cross member and the under-sized transverse bracket tab, resulting in angular motion between the cross member and the vertical member. The amount of allowed angular motion may be readily controlled by the degree of cross-sectional size mismatch, and the length of the transverse bracket tab inserted into the cross member, with longer tabs and less mismatch resulting in smaller allowed angular motion. The retaining pins 318/338 should be long enough to retain cross members on the tabs in spite of any cross-sectional size mismatch. Many other types of mechanical joints may be employed for joining cross members 140/150 to vertical members 120 via brackets 110/130 while remaining within the scope of the present disclosure and/or appended claims. These may include, but are not limited to: hinge joints, ball-and-socket joints, multi-axis joints, universal joints, combinations thereof, and/or functional equivalents thereof.

The range of allowed angular motion may vary widely depending on desired and/or required performance characteristics for the tank. Substantially free angular motion in all directions (±180°) may allow the tank frame 100 to be folded when not in use and may allow deployment on more rough, more uneven, and/or more sloped terrain, but may be more difficult to erect for deployment and/or may offer insufficient structural rigidity in some deployment circumstances. A range of allowed angular motion significantly restricted in all directions (less than ±1°, for example) may offer ease of assembly and substantial structural rigidity, but may not be deployable on terrain that is too rough, too uneven, and/or too sloped. Various ranges of allowed angular motion of cross members 140/150 relative to vertical members 120 may be employed, such as ±1°, ±3°, ±5°, ±6°, ±10°, ±20°, ±30°, ±45°, ±60°, and/or ±90°. Ranges of allowed angular motion between about ±1° and about ±6° may allow deployment under most conditions, and ranges between about ±3° and about ±5° may allow deployment under many conditions typically encountered. It may be desirable to have differing angular ranges for different angular motions and/or for different joints within the tank frame. For example, it may be desirable in some circumstances to allow greater angular motion in the horizontal dimension while allowing less angular motion in the vertical dimension, resulting in a tank frame 100 having a polygonal shape that may be varied widely but that may only be deployable on relatively level and even terrain. Conversely, in other circumstances it may be desirable to allow greater angular motion in the vertical dimension while allowing relatively less angular motion in the horizontal dimension, resulting in a tank frame 100 that may be deployed on terrain quite rough, uneven, and/or sloped but that may be deployed only in a substantially fixed polygonal shape. The various angular ranges given above may be implemented independently for each degree of allowed angular motion in any suitable combination. In some circumstances in may be desirable to substantially eliminate angular motion in one or more dimensions, while allowing angular motion in one or more other dimensions.

A single substantially vertical retaining pin 318/338 for each transverse bracket tab 316/336 is shown in the exemplary embodiment. A single substantially horizontal retaining pin may be equivalently employed. Opposing pairs of retractable spring-loaded retaining pins 318/338 may be employed, either vertically oriented or horizontally oriented. Cross members 140/150 may be provided with additional holes 142/152 for accommodating such a pair of retaining pins (or for allowing attachment of the cross members in either of two orientations with a single retaining pin; or for allowing a retaining pin to pass completely through the cross member, as described further below). While the pins 318/

338 are shown as retractable pins integrated into transverse tabs 316/336, they could be provided in any of a wide variety of other mechanical configurations (not shown). For example, pins 318/338 could be provided as completely separate parts inserted through holes 142/152 into mating holes in the transverse bracket tabs 316/336. Such holes may be blind holes, or may extend through tabs 316/336, and such holes may be threaded holes or clearance holes. Threaded retaining pins 318/338 may be inserted through holes 142/152 and threadedly engaged with a threaded hole in tabs 316/336. Threaded retaining pins 318/338 may be inserted through holes 142/152, through clearance holes through tabs 316/336, through second holes 142/152 (if present), and a threaded nut engaged on the retaining pin. The transverse tabs 316/336 of the exemplary embodiment are shown inserted into hollow members 140/150. Equivalently, ends of members 140/150 may instead be inserted into hollow tabs provided on the brackets. Myriad other mechanical configuration may be contrived for securing cross members 140/150 to vertical members 120 via brackets 110/130 while remaining within the scope of the present disclosure and/or appended claims.

Each retaining pin 318/338 may act as a rotation axis for one dimension of angular motion at a particular tank frame joint, and the presence of the retaining pin does not substantially limit angular motion in that dimension (the horizontal dimension about a vertical pin/axis in the exemplary embodiment, the motion in the horizontal dimension instead being limited by the size mismatch of the cross member and inserted tab). Rotation in the vertical dimension (about a horizontal axis) in the exemplary embodiment is limited by size mismatch between the cross member and the inserted tab, but also by size mismatch between the retaining pin and the hole 142/152 in the cross member. The greater this latter size mismatch, the greater the allowed vertical rotation. The retaining pin/hole mismatch is even more determinative of the allowed range of angular motion when two opposing retaining pins are employed, or when a single retaining pin passes completely through both the cross member and the tab. As already stated above, the retaining pins may be substantially vertical or substantially horizontal, and the choice may depend in part on the desired ranges and orientations of allowed angular motions among the tank frame member 120/140/150.

The tank liner 200 is shown in FIGS. 4 and 5A/5B. The tank liner material should be sufficiently strong to withstand the fluid pressure exerted by the fluid in the tank, and should be flexible and substantially fluid impervious. Vinyl (suitably reinforced if desired or necessary) is a suitable liner material. Other liner materials may include, but are not limited to, plastics, rubbers, polymers, canvas or other fabrics (suitably treated and/or coated so as to be substantially fluid impervious), combinations thereof, and/or functional equivalents thereof. Suitable materials must enable joining to form substantially fluid-tight seams. Any suitable method may be employed for forming such seams, including stitching, gluing, adhesives, thermal bonding, chemical welding, other similar techniques, combinations thereof, and/or functional equivalents thereof. The liner pieces shown in FIGS. 5A/5B illustrate one example of how the liner material may be cut and assembled to form a tank liner 200 with side panels 210 and bottom panel 220. The top edges of the liner side panels are folded over and secured (by any suitable technique as described above) to form liner sleeves 230. Holes in the liner material become the liner gaps 240 between the liner sleeves 230. While it has been pointed out hereinabove that a wide range of possibilities exist for selecting a polygonal shape for tank frame 100, the range is significantly limited for a tank liner 200, since the liner bottom panel 220 must be cut to a particular polygonal shape. For a given assembled tank liner 200, a range of tank frame shapes may be implemented, particularly for accommodating rough, uneven, and/or sloped terrain. To accommodate major alteration of the polygonal tank shape (particularly in the horizontal dimension), however, a different assembled tank liner may be required even if the same tank frame 100 could be used. The tank liner may be provided with a drain opening 250 for drawing fluid from the tank (to use the fluid and/or for emptying the tank). Drain opening 250 is provided with a closure of any suitable type (including a valve or threaded plug, for example), and may be further adapted (by a suitable fitting or other adaptation) for connection to a hose, pipe, or other suitable conduit for carrying fluid.

Figure 6B:
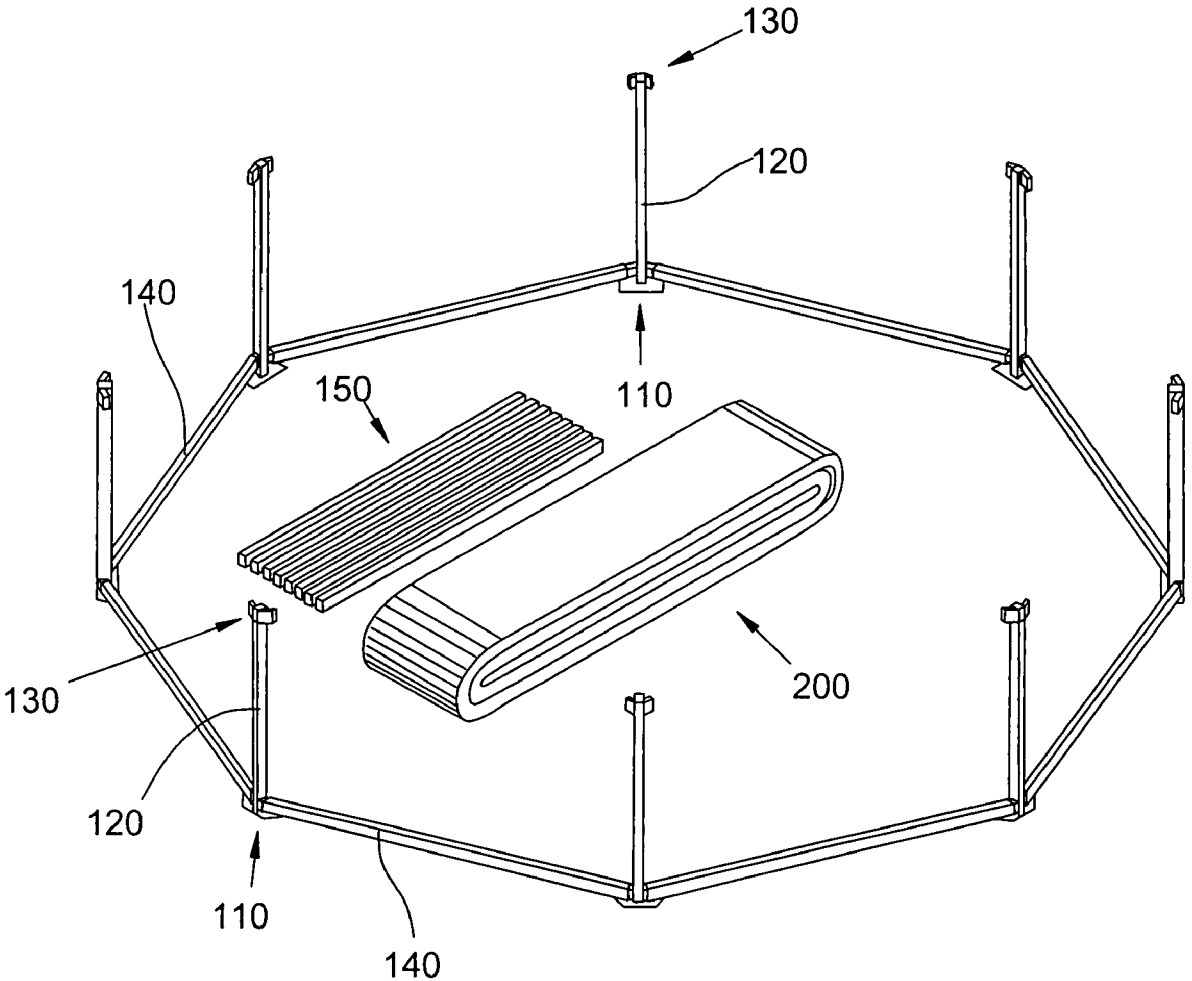
Figure 6C:
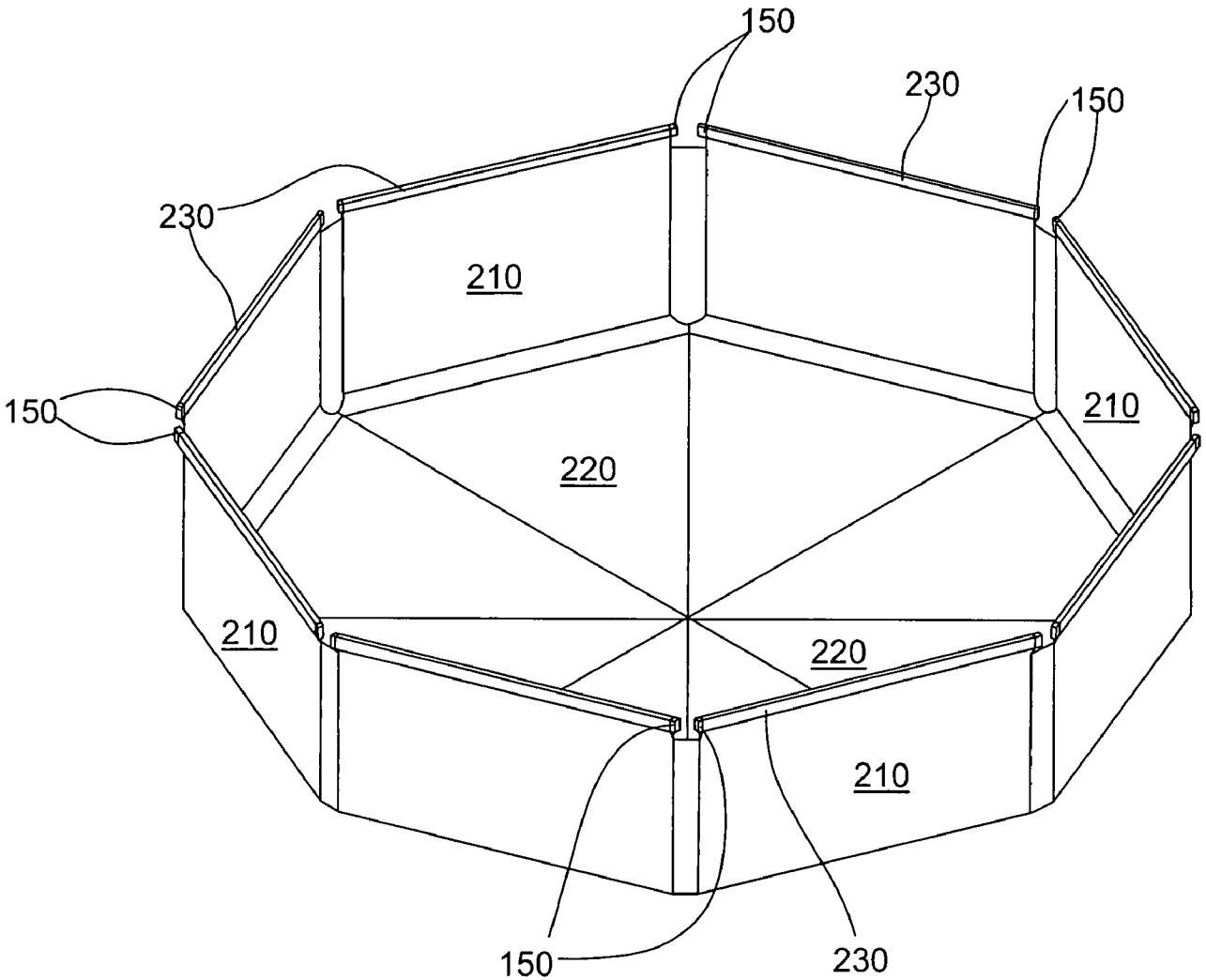
Figure 6D:
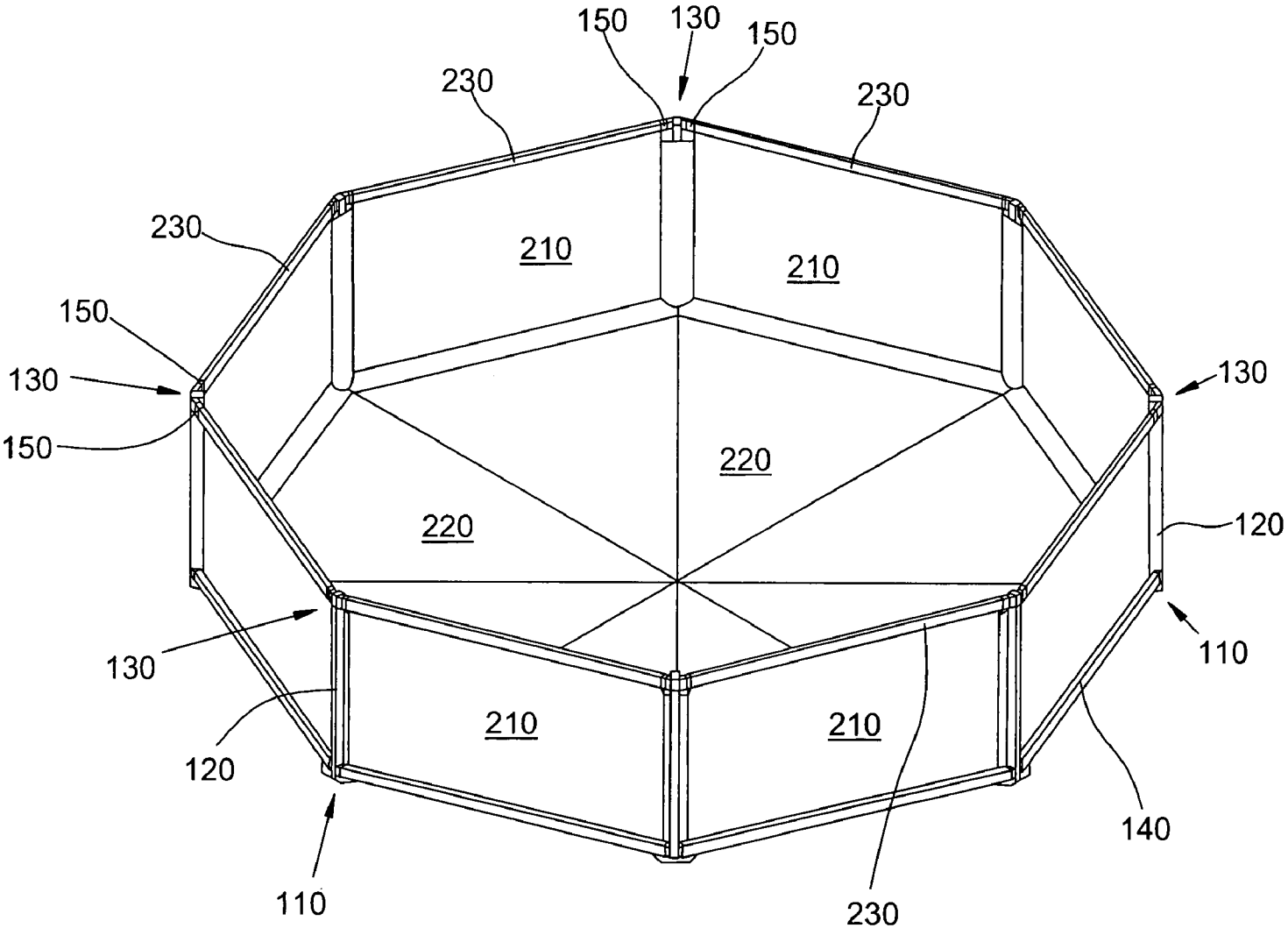

Assembly of the fluid storage tank may occur in various stages and in various settings while remaining within the scope of the present disclosure and/or appended claims. For example, fabrication of frame members 120/140/150 and brackets 110/130 may occur within a manufacturing facility, along with assembly of the brackets 110/130 onto vertical members 120. The tank liner 200 may be completely fabricated/assembled in a manufacturing facility as well. Final assembly of the tank may occur at the desired location of the tank, and is illustrated in FIGS. 6A/6B/6C/6D. FIG. 6A shows the parts for the tank laid out but not yet assembled. Lower cross members 140 are secured to lower brackets 110 of the vertical support members, yielding the polygonal shape of the tank as in FIG. 6B. The upper cross members 150 are inserted through liner sleeves 230, as shown in FIG. 6C. The liner 200 is positioned within the polygon formed by the secured lower cross members 140 with the liner gaps 240 positioned at the upper brackets 130. The upper cross members (within liner sleeves 230) are secured to the upper brackets 130 to form an upper polygonal portion of tank frame 100 and completing assembly of the tank. Angular motion of cross members 140/150 relative to vertical members 120 enables assembly of the tank on terrain that may be rough, uneven, and/or sloped, perhaps enough so that a rigid tank frame could not have been deployed.

Once the fluid storage tank is no longer needed at its assembly location, it may be emptied, disassembled, and transported to another assembly location, or to a storage location to await future use. After emptying the tank, the steps illustrated in FIGS. 6A/6B/6C/6D and described hereinabove are simply reversed. Alternatively, if the assembly location is to be a substantially permanent location for the tank, it may be desirable to substantially permanently secure frame members 120/140/150 and brackets 110/130 together by suitable fasteners, adhesives, welding, or other suitable means.

One common use for fluid storage tanks as disclosed herein is use as a water relay tank for fire fighting and/or fire suppression in remote areas (i.e., rural, wilderness, and/or other areas where hydrants would not be available, and water must be transported to near the fire location). Such tanks must be transported to remote locations and assembled very quickly on unknown and potentially rough, uneven, and/or sloped terrain. A fluid storage tank as disclosed herein may be quite lightweight and readily transported by a single firefighter on foot, by horseback, ATV, truck, off-road vehicle, or by airlift. As examples, a 1000 gallon octagonal tank weighs less than 70 pounds (tank frame elements and tank liner), while a 3000 gallon tank weighs less than 110 pounds. Each may be assembled in under five minutes by a lone firefighter. The structure remains mechanically stable during filling of the tank and also during subsequent emptying of the tank. The water from the tank may be used directly on the fire, or may be pumped to another tank at a higher elevation (as one step in a series of tanks for transporting water up elevated terrain). Once the tank is no longer needed at a particular remote location, it maybe readily disassembled and transported, either to a new deployment location or to a storage facility to await future use. Other uses for such fluid storage tanks may include but are not limited to: livestock watering, agricultural irrigation, temporary water supplies during service disruptions or natural disasters, and so forth.

For fire-fighting in remote areas, rapid transportation of the tank(s) is of paramount importance. A carrying container may be provided that holds the folded tank liner, vertical support members, and cross members, and may enable a single person to carry the tank into a remote area for deployment. The size of the container (and the size of the tank liner and tank frame components therein) may be sized to allow stowage in helicopters for airborne delivery to a remote area, or to allow ready stowage in standard storage compartments of fire engines. The size and weight of the container (with the tank liner and tank frame components therein) may be limited so as to fall within size/weight restrictions of overnight delivery services (UPS, FedEx, and so forth). Limits of 150 pounds of weight, 108 inches of length, and 130 inches of length plus girth, fall within most such restrictions, and tanks having capacities of at least 1000 gallons up to 3000 gallons may fall within these limits when constructed according to the present disclosure. The ability to use overnight delivery services for transporting tanks, thereby enabling rapid transport of tanks from one region to another as dictated by the geographic distribution of fires, is a significant advantage.

It is intended that equivalents of the disclosed exemplary embodiments and methods shall fall within the scope of the present disclosure and/or appended claims. It is intended that the disclosed exemplary embodiments and methods, and equivalents thereof, may be modified while remaining within the scope of the present disclosure and/or appended claims.

What is claimed is:

1. A fluid storage tank, comprising:

a tank frame, comprising a plurality of vertical support members, each vertical support member comprising a substantially rigid substantially vertical frame member and upper and lower brackets secured thereto near respective upper and lower ends thereof, a plurality of substantially rigid lower cross members, each end of each lower cross member being connected to the lower bracket of an adjacent one of the vertical support members so that the plurality of lower cross members thus connected form a lower closed polygon with one of the vertical support members positioned at each vertex thereof, a plurality of substantially rigid upper cross members, each end of each upper cross member being connected to the upper bracket of an adjacent one of the vertical support members so that the plurality of upper cross members thus connected form an upper closed polygon with one of the vertical support members positioned at each vertex thereof, the upper polygon substantially corresponding in size and shape to the lower polygon; and a tank liner, comprising a polygonal bottom panel, substantially corresponding in size and shape to the upper and lower polygons, a plurality of substantially vertical side panels, each side panel secured at a lower edge thereof to an edge of the polygonal bottom panel and at side edges thereof to side edges of adjacent side panels, each side panel having a liner sleeve running along an upper edge thereof open at both ends and substantially corresponding to a side of the upper polygon, the liner sleeves being spaced apart by liner gaps therebetween, each liner gap corresponding to a vertex of the upper polygon, wherein:

each upper cross member is positioned within a corresponding one of the liner sleeves, and each of the upper brackets is positioned at a corresponding one of the liner gaps, each of the upper and lower cross members is connected to the respective upper and lower brackets so as to allow relative angular motion between the vertical frame members and the connected upper and lower cross members.

2. The apparatus of claim 1, wherein the fluid storage tank may be repeatedly disassembled into separate tank liner, vertical support members, lower cross members, and upper cross members, and repeatedly reassembled.

3. The apparatus of claim 2, wherein the tank liner, vertical support members, lower cross members, and upper cross members together weigh less than about 110 pounds, and the capacity of the assembled tank is greater than about 1000 gallons.

4. The apparatus of claim 2, wherein all of the upper and lower cross members are substantially identical.

5. The apparatus of claim 2, further comprising a carrying container, wherein the tank liner, vertical support members, lower cross members, and upper cross members all fit into the container together.

6. The apparatus of claim 5, wherein:

the container with the tank liner, vertical support members, lower cross members, and upper cross members together therein weighs less than about 150 pounds;

the length of the container with the tank liner, vertical support members, lower cross members, and upper cross members together therein is less than about 108 inches;

a sum of the length and the girth of the container with the tank liner, vertical support members, lower cross members, and upper cross members together therein is less than about 130 inches; and the capacity of the assembled tank is at least 1000 gallons.

7. The apparatus of claim 1, wherein the tank liner includes a drain opening and a closure therefor.

8. The apparatus of claim 1, wherein:

each of the upper and lower brackets includes a pair of transverse bracket tabs;

each of the upper and lower cross members comprises an elongated hollow member; and each transverse bracket tab is received within an open end of the corresponding cross member when the corresponding cross member is connected to the corresponding bracket.

9. The apparatus of claim 8, wherein each upper and lower cross member has a transverse hole at each end thereof, and each end of each cross member is connected to the corresponding bracket by a retaining pin received within the hole.

10. The apparatus of claim 9, wherein each retaining pin is retractably mounted on a corresponding one of the transverse bracket tabs.

11. The apparatus of claim 9, wherein each retaining pin acts as a pivot for relative angular motion between the corresponding vertical frame member and connected cross member.

12. The apparatus of claim 8, wherein each transverse bracket tab is smaller than the corresponding open end of the corresponding cross member so that relative motion of the bracket tab within the open end of the cross member enables relative angular motion between the corresponding vertical frame member and connected cross member.

13. The apparatus of claim 1, wherein a range of relative angular motion allowed between the vertical frame members and the connected upper and lower cross members is between about ±1° and about ±6°.

14. The apparatus of claim 13, wherein a range of relative angular motion allowed between the vertical frame members and the connected upper and lower cross members is between about ±3° and about ±5°.

15. The apparatus of claim 1, wherein the upper and lower polygons each have at least five sides.

16. The apparatus of claim 15, wherein the upper and lower polygons each have eight sides.

17. A method for assembling a fluid storage tank, comprising:

connecting a plurality of substantially rigid lower cross members to lower brackets of a plurality of vertical support members, each vertical support member comprising a substantially rigid substantially vertical frame member and upper and lower brackets secured thereto near respective upper and lower ends thereof, each lower cross member being connected at each end thereof to the lower bracket of one of the vertical support members so that the plurality of lower cross members thus connected form a lower closed polygon with one of the vertical support members positioned at each vertex thereof, each of the lower cross members being connected to the respective lower bracket so as to enable relative angular motion between the vertical frame members and the connected lower cross members;

inserting each of a plurality of substantially rigid upper cross members into a corresponding liner sleeve of a tank liner, the tank liner comprising a polygonal bottom panel, substantially corresponding in size and shape to the lower polygon, a plurality of substantially vertical side panels, each side panel secured at a lower edge thereof to a side edge of the polygonal bottom panel, each side panel having a liner sleeve running along an upper edge thereof open at both ends and substantially corresponding to a side of the lower polygon, the liner sleeves being spaced apart by liner gaps therebetween, each liner gap corresponding to a vertex of the lower polygon;

positioning the tank liner and upper cross members within the lower polygon with each of the liner gaps positioned at a corresponding one of the vertical support members; and connecting the plurality of upper cross members to the upper brackets of the vertical support members, each upper cross member being connected at each end thereof to the upper bracket of one of the vertical support members so that the plurality of upper cross members thus connected form an upper closed polygon with one of the vertical support members at each vertex thereof, the upper polygon substantially corresponding in size and shape to the lower polygon, each of the upper cross members being connected to the respective upper bracket so as to enable relative angular motion between the vertical frame members and the connected upper cross members.

18. The method of claim 17, further comprising disassembling the fluid storage tank, wherein disassembling the tank comprises:

disconnecting the upper cross members from the corresponding upper brackets;

removing the upper cross members from the respective liner sleeves; and disconnecting the lower cross members from the corresponding lower brackets.

19. The method of claim 18, further comprising repeatedly disassembling and repeatedly reassembling the fluid storage tank.

20. The method of claim 18, wherein the tank liner, vertical support members, lower cross members, and upper cross members together weigh less than about 110 pounds, and the capacity of the tank is greater than about 1000 gallons.

21. The method of claim 18, wherein all of the upper and lower cross members are substantially identical.

22. The method of claim 18, further comprising:

folding the tank liner; and packing the folded liner, the upper and lower cross members, and the vertical support members together in a carrying container.

23. The method of claim 22, wherein:

the container with the tank liner, vertical support members, lower cross members, and upper cross members together therein weighs less than about 150 pounds;

the length of the container with the tank liner, vertical support members, lower cross members, and upper cross members together therein is less than about 108 inches;

a sum of the length and the girth of the container with the tank liner, vertical support members, lower cross members, and upper cross members together therein is less than about 130 inches; and the capacity of the assembled tank is at least 1000 gallons.

24. The method of claim 17, wherein the tank liner includes a drain opening and a closure therefor.

25. The method of claim 17, wherein each of the upper and lower brackets includes a pair of transverse bracket tabs, and each of the upper and lower cross members comprises an elongated hollow member, the method further comprising inserting each transverse bracket tab into an open end of the corresponding cross member for connecting the corresponding cross member to the corresponding bracket.

26. The method of claim 25, wherein each upper and lower cross member has a transverse hole at each end thereof, and each end of each cross member is connected to the corresponding bracket by a retaining pin received within the hole.

27. The method of claim 26, wherein each retaining pin is retractably mounted on a corresponding one of the transverse bracket tabs.

28. The method of claim 26, wherein each retaining pin acts as a pivot for relative angular motion between the corresponding vertical frame member and connected cross member.

29. The method of claim 25, wherein each transverse bracket tab is smaller than the corresponding open end of the corresponding cross member so that relative motion of the bracket tab within the open end of the cross member enables relative angular motion between the corresponding vertical frame member and connected cross member.

30. The method of claim 17, wherein a range of relative angular motion allowed between the vertical frame members and the connected upper and lower cross members is between about ±1° and about ±6°.

31. The method of claim 30, wherein a range of relative angular motion allowed between the vertical frame members and the connected upper and lower cross members is between about ±3° and about ±5°.

32. The method of claim 17, wherein the upper and lower polygons each have at least five sides.

33. The method of claim 32, wherein the upper and lower polygons each have eight sides.

34. The method of claim 17, further comprising:

prior to assembling the tank, transporting the tank liner, vertical support members, lower cross members, and upper cross members to a location near a fire in a remote area;

assembling the tank at the remote location;

after assembling the tank, filling the tank with water at the remote location.

35. The method of claim 34, further comprising pumping water from the tank to suppress the fire.

36. The method of claim 34, further comprising pumping water from the tank to another tank at a higher elevation.

37. The method of claim 34, further comprising disassembling the tank and transporting the tank out of the remote area.

38. A fluid storage tank, comprising:

a tank frame, comprising a plurality of substantially rigid substantially vertical frame members, a plurality of substantially rigid lower cross members, a plurality of substantially rigid upper cross members, means for connecting each end of each lower cross member to a corresponding vertical frame member near a lower end thereof so as to allow a range of relative angular motion between the vertical frame member and the connected lower cross member, the lower cross members thus connected forming a lower closed polygon with one of the vertical frame members positioned at each vertex thereof, means for connecting each end of each upper cross member to a corresponding vertical frame member near an upper end thereof so as to allow a range of relative angular motion between the vertical frame member and the connected upper cross member, the upper cross members thus connected forming an upper closed polygon with one of the vertical frame members positioned at each vertex thereof, the upper polygon substantially corresponding in size and shape to the lower polygon; and a tank liner, comprising a polygonal bottom panel, substantially corresponding in size and shape to the upper and lower polygons, a plurality of substantially vertical side panels, each side panel secured at a lower edge thereof to an edge of the polygonal bottom panel, each side panel having a liner sleeve running along an upper edge thereof open at both ends and substantially corresponding to a side of the upper polygon, the liner sleeves being spaced apart by liner gaps therebetween, each liner gap corresponding to a vertex of the upper polygon, wherein each upper cross member is positioned within a corresponding one of the liner sleeves, and each of the vertical frame members is positioned at a corresponding one of the liner gaps.

39. The apparatus of claim 38, wherein the fluid storage tank may be repeatedly disassembled into separate tank liner, vertical frame members, lower cross members, and upper cross members, and repeatedly reassembled.

40. The apparatus of claim 39, further comprising a carrying container, wherein the tank liner, vertical support members, lower cross members, and upper cross members all fit into the container together.

41. The apparatus of claim 40, wherein:

the container with the tank liner, vertical support members, lower cross members, and upper cross members together therein weighs less than about 150 pounds;

the length of the container with the tank liner, vertical support members, lower cross members, and upper cross members together therein is less than about 108 inches;

a sum of the length and the girth of the container with the tank liner, vertical support members, lower cross members, and upper cross members together therein is less than about 130 inches; and the capacity of the assembled tank is at least 1000 gallons.

42. The apparatus of claim 38, wherein a range of relative angular motion allowed between the vertical frame members and the connected upper and lower cross members is between about ±1° and about ±6°.

43. The apparatus of claim 42, wherein a range of relative angular motion allowed between the vertical frame members and the connected upper and lower cross members is between about ±3° and about ±5°.

44. The apparatus of claim 38, wherein the upper and lower polygons each have at least five sides.

45. The apparatus of claim 44, wherein the upper and lower polygons each have eight sides.

* * * * *